US011359435B2

(12) United States Patent
Diamond et al.

(10) Patent No.: US 11,359,435 B2
(45) Date of Patent: Jun. 14, 2022

(54) SCREEN ASSEMBLY

(71) Applicant: Fourds Limited, Magherafelt (GB)

(72) Inventors: Cormac Diamond, Bellaghy (GB); Kevin McCullagh, Castledawson (GB); Patrick McGirr, Beragh (GB); Shay McGuinness, Magherafelt (GB)

(73) Assignee: Fourds Limited, Magherafelt (GB)

( * ) Notice: Subject to any disclaimer, the term of this patent is extended or adjusted under 35 U.S.C. 154(b) by 0 days.

(21) Appl. No.: 16/953,063

(22) Filed: Nov. 19, 2020

(65) Prior Publication Data

US 2021/0148165 A1 May 20, 2021

(30) Foreign Application Priority Data

Nov. 20, 2019 (GB) ..... 1916913

(51) Int. Cl.
*E06B 9/58* (2006.01)
*E06B 9/42* (2006.01)

(52) U.S. Cl.
CPC ..... *E06B 9/58* (2013.01); *E06B 9/42* (2013.01); *E06B 2009/587* (2013.01)

(58) Field of Classification Search
CPC ..... E06B 9/42; E06B 2009/587; E06B 9/58; A47H 1/13
USPC ..... 160/271
See application file for complete search history.

(56) References Cited

U.S. PATENT DOCUMENTS

| | | | | |
|---|---|---|---|---|
| 2,041,105 | A | 5/1936 | Barnhart | |
| 6,666,251 | B2 * | 12/2003 | Ikle | E06B 9/11 160/120 |
| 7,093,643 | B2 * | 8/2006 | Ikle | E06B 9/11 160/120 |
| 10,017,983 | B1 * | 7/2018 | McSparrin | E06B 9/42 |
| 2002/0100562 | A1 | 8/2002 | Ikle | |
| 2019/0360200 | A1 | 11/2019 | Sloss | |

FOREIGN PATENT DOCUMENTS

| | | |
|---|---|---|
| CN | 209067080 | 7/2019 |
| EP | 0870896 | 10/1998 |

OTHER PUBLICATIONS

UK Search Report of corresponding Application No. GB1916913.5, dated May 14, 2020.
EU Search Report of corresponding Application No. EP20206995.1, dated Apr. 15, 2021.

* cited by examiner

*Primary Examiner* — Beth A Stephan
(74) *Attorney, Agent, or Firm* — Gardner, Linn, Burkhart & Ondersma LLP

(57) ABSTRACT

A screen assembly for a window includes a pair of parallel and spaced apart side rails locatable against respective sides of a window opening, and a head assembly including a roller upon which is wound a screen. The head assembly extends between the side rails and is adapted to be mounted on upper ends of the side rails to be supported thereon against and/or adjacent to an upper side of the window opening. Each side rail is linearly extendable whereby the upper and lower ends of the side rails frictionally engage upper and lower faces of a window opening to secure the side rails, and the head assembly mounted thereon, in place within the window opening.

20 Claims, 10 Drawing Sheets

SCREEN ASSEMBLY

CROSS REFERENCE TO RELATED APPLICATION

The present application claims priority benefit of U.K. Pat. Application Ser. No. 1916913.5, filed Nov. 20, 2019, which is hereby incorporated herein by reference in its entirety.

FIELD OF THE INVENTION

This invention relates to a screen assembly, and in particular to a screen assembly that can be installed without drilling holes into the sides of a window opening into which the screen assembly is to be installed.

BACKGROUND OF THE INVENTION

Windows are typically provided with screen assemblies fitted to the window opening, typically fixed between the sides of the window opening adjacent the upper face thereof by suitable mounting brackets, for selectively obscuring the window. In the case of a roller blind, such screen assemblies typically have a roller rotatably mounted at an upper side of the frame around which a suitable screen is wound. The screen may be lowered and raised by rotating the roller, typically by use of an endless chain or cord extending around a sprocket engaged with one end of the roller. The lower end of the screen may be provided with a guide bar such that the screen hangs from the roller under gravity.

A problem with such known screen assemblies is that the width of the roller must be accurately matched to the width of the window opening to enable the screen assembly to be mounted within the window opening. Furthermore, gaps between the sides of the screen and the sides of the window opening may prevent the screen from completely shutting out light when the screen is closed.

Furthermore, the mounting brackets for supporting the screen assembly within the window opening are typically attached to the upper sides of the window opening by screws inserted into holes which must be accurately drilled into the sides of the window opening, which often requires skilled fitting and can result in damage to the window opening. It is also problematic to mount such brackets at positions to ensure that the roller of the screen assembly is level so that the screen moves parallel to the sides of the window opening as it is opened and closed.

SUMMARY OF THE INVENTION

The present invention provides a screen assembly that can be easily installed in a window opening without the use of additional fasteners or the drilling of holes into the window opening. According to one form of the present invention there is provided a screen assembly for a window, the assembly including a pair of parallel and spaced apart side rails locatable against respective sides of a window opening and a head assembly. The head assembly includes a roller upon which is wound a screen, with the head assembly extending between the side rails and being adapted to be mounted on upper ends of the side rails to be supported thereon against and/or adjacent to an upper side of the window opening. Each side rail is linearly extendable so that upper and lower ends of each side rail frictionally engage upper and lower faces of a window opening to secure the side rails, and the head assembly mounted thereon, in place within the window opening.

Optionally, a foot is provided at each end of each side rail adapted to frictionally engage respective upper and lower faces of the window opening, at least one of the feet of each side rail being linearly extendable from the remainder of the respective side rail to adjust the length of the side rail.

In one embodiment an upper foot at an upper end of each side rail may be linearly extendable therefrom, a drive being provided for extending the upper foot from the respective side rail. The drive may include a threaded rod adapted to be screwed out of a threaded base member of the respective side rail to extend the upper foot from the respective side rail. The threaded rod may be provided with a formation for engagement by a tool to facilitate rotation of the threaded rod and extension of the upper foot from the respective side rail.

The head assembly may include an elongate hollow housing adapted to enclose the roller and a portion of the screen wound thereon and extending between a pair of end caps fitted on either end of the housing, wherein the screen is arranged to extend through an elongate gap in a lower side of the housing. Each end cap may include a mount or mounting for supporting a respective end of the roller and an attachment assembly for attaching the head assembly to the side rails.

At least one of the end caps may be telescopically fitted over a respective end of the housing and includes a biasing device, such as a spring, for urging the respective end cap towards an extended position, thereby adjusting the width of the head assembly to allow for variation in the width of the window opening. The attachment assembly of each end cap of the head assembly may include a first part engageable with a second part provided at an upper end of each side rail, the first and second parts being adapted to coupled together at a plurality of different vertical positions with respect to one another to allow the vertical position of each end cap to be adjusted on the respective side rail to facilitate levelling of the head assembly In one embodiment the first part of each attachment assembly may include vertically spaced and substantially horizontally extending opposed channels extending parallel to an end surface of the respective end cap to define a vertically aligned and horizontally extending slot into which is slidingly received a pair of parallel legs extending substantially horizontally from an upper end of each side rail, the legs defining the second part of the respective attachment assembly. Inner faces of the channels and cooperating outer faces of the legs may be provided with cooperating serrated or tooth like formations adapted to engage one another as the legs are slid into the channels such that the end caps can be mounted on the respective side rails in a number of different vertically spaced positions.

Optionally, the relative vertical location and level of the head assembly with respect to an upper side of the window opening is adjustable within the limits of the difference between the distance between upper and lower faces of the legs and the width of the slot defined by the channels within which the legs are received.

Locking members may be insertable through receiving channels in the end caps of the head assembly to engage receiving apertures formed in the side rails to secure the head assembly to the side rails.

The side rails may define a pair of opposing substantially U shaped guide tracks adapted to extend perpendicular to the respective sides of the window opening and within which a respective edge region of the screen is guided during raising and lowering of the screen. A guide bar may be mounted on a lower end of the screen, the guide bar being adapted to slide within the guide tracks defined by the side rails.

In another aspect of the invention there is provided a screen assembly for a window including a pair of parallel and spaced apart side rails locatable against respective sides of a window opening and a head assembly, including a roller upon which is wound a screen, the head assembly extending between the side rails and being adapted to be mounted on upper ends of the side rails to be supported thereon against and/or adjacent to an upper side of the window opening, wherein the head assembly includes an elongate hollow housing adapted to enclose the roller and a portion of the screen wound thereon and extending between a pair of end caps fitted on either end of the housing, the screen being arranged to extend through an elongate gap in a lower side of the housing, each end cap including a mount or mounting means for supporting a respective end of the roller and an attachment assembly for attaching the head assembly to the side rails, the attachment assembly of each end cap of the head assembly including a first part engageable with a second part provided at an upper end of each side rail, and wherein the first and second parts are adapted to coupled together at a plurality of different vertical positions with respect to one another to allow the vertical position of each end cap to be adjusted on the respective side rail to facilitate levelling of the head assembly.

These and other objects, advantages, purposes and features of the present invention will become apparent upon review of the following specification in conjunction with the drawings.

BRIEF DESCRIPTION OF THE DRAWINGS

A screen assembly in accordance with an embodiment of the present invention will now be described, by way of example only, with reference to the accompanying drawings, in which:—

DETAILED DESCRIPTION OF THE DRAWINGS

Figure 1:
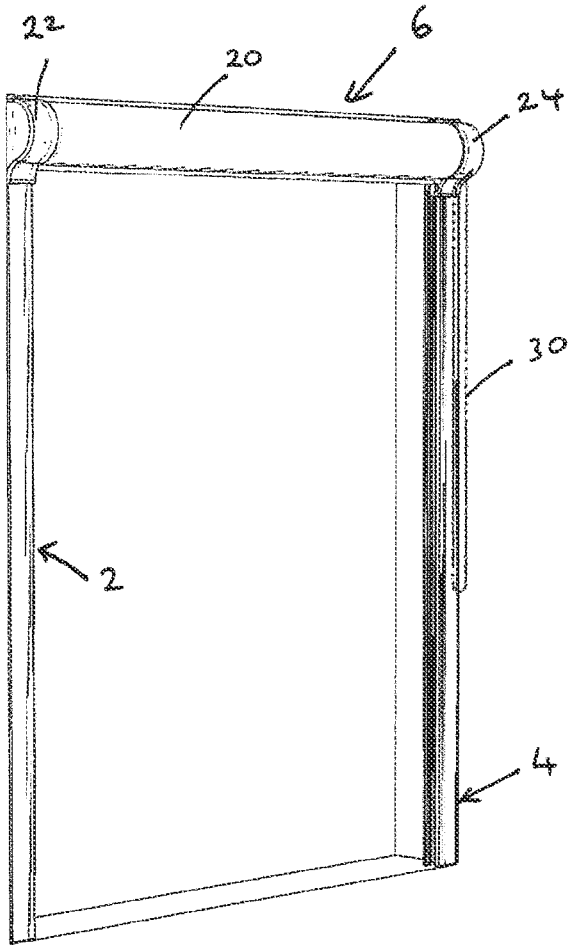
FIG. 1 is a perspective view of a screen assembly in accordance with an embodiment of the present invention, shown installed in a window opening.
Figure 2:
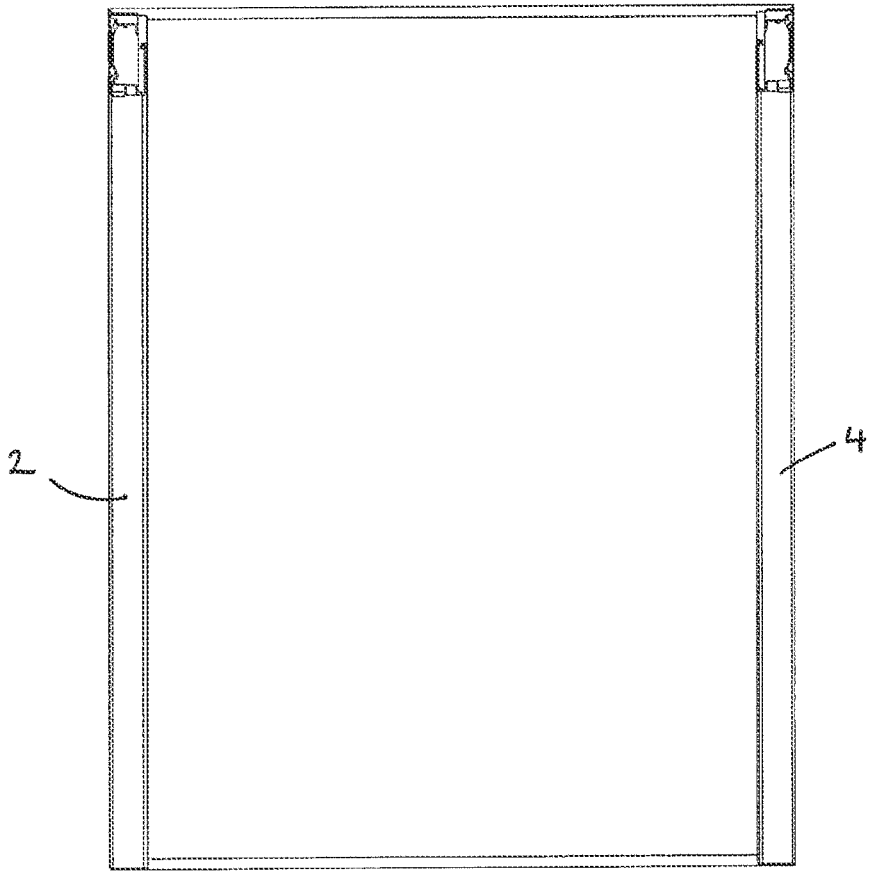
FIG. 2 is a front view of the screen assembly of FIG. 1 prior to attachment of the head assembly.

As illustrated in the drawings, a screen assembly in accordance with an embodiment of the present invention includes a pair of parallel and spaced apart side rails 2,4 locatable against respective sides of a window opening and a head assembly 6, including a roller 8 upon which is wound a screen 10. The head assembly 6 extends between the side rails 2,4 and is mounted on upper ends of the side rails 2,4 to be supported thereon against and/or adjacent to an upper side of the window opening.

In the description and claims the terms "upper" and "lower" refer the orientation of the screen assembly when installed in a window opening.

Each side rail 2,4 is adjustable in length such that the respective side rail can be linearly extended so that upper and lower ends of the side rail frictionally engage upper and lower faces of a window opening to secure the side rails 2,4, and the head assembly 6 mounted thereon, in place within the window opening. Therefore no attachment hardware needs to be installed into the window opening to install the screen assembly therein.

In one embodiment, a foot is provided at each end of each side rail adapted to frictionally engage respective upper and lower faces of the window opening, at least one of the feet of each side rail being linearly extendable from the remainder of the respective side rail to adjust the length of the side rail. In the embodiment shown in the drawings, an upper foot 12 at an upper end of each side rail 2,4 is linearly extendable therefrom, a drive being provided for extending the upper foot 12 from the respective side rail 2,4.

Figure 3:
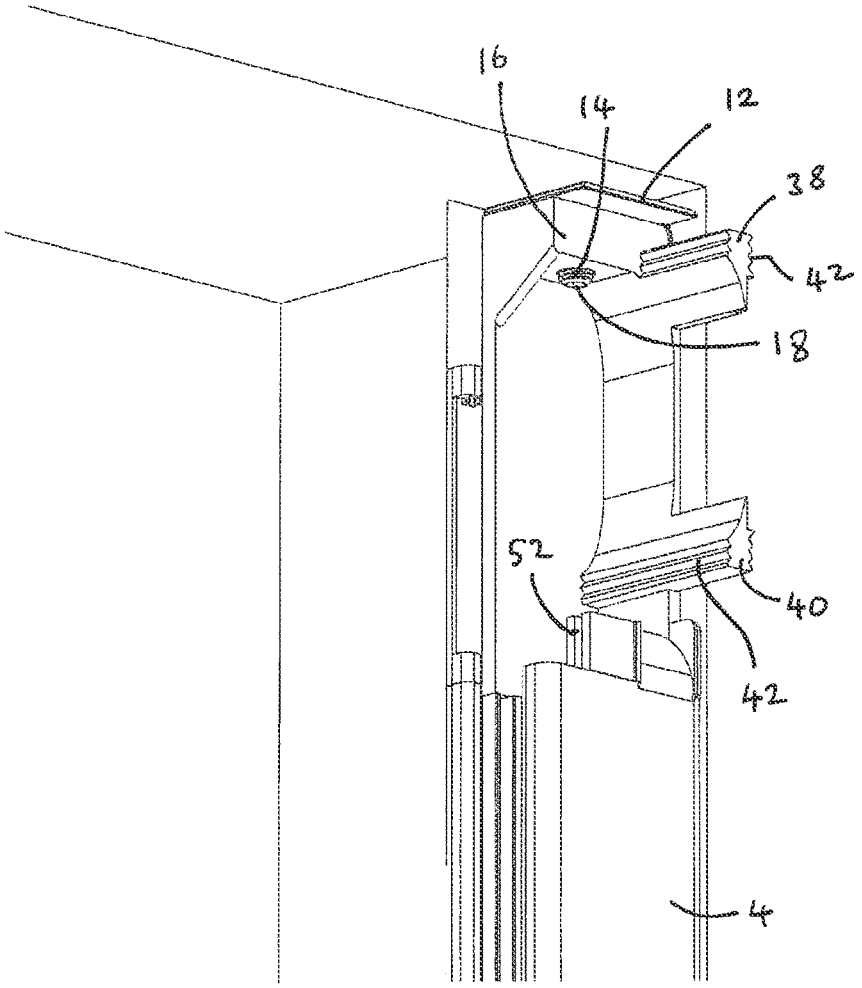
FIGS. 3 and 4 are detailed perspective views of an upper part of a right hand side rail of the screen assembly of FIG. 1.
Figure 4:
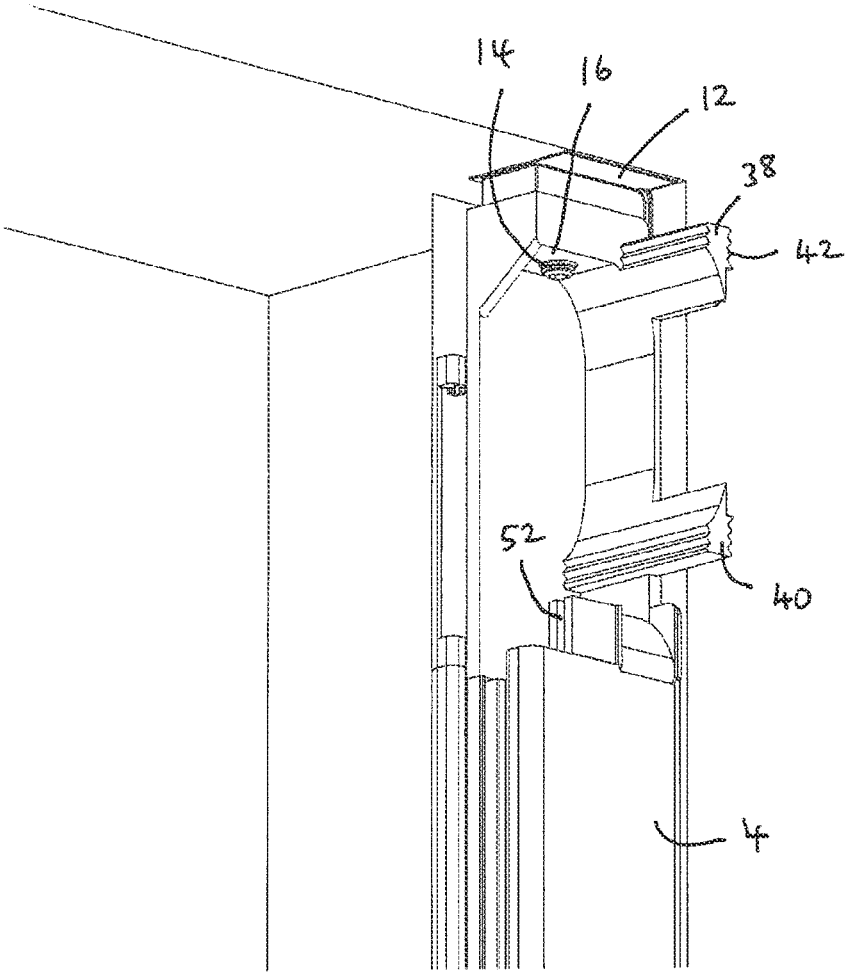
Figure 5:
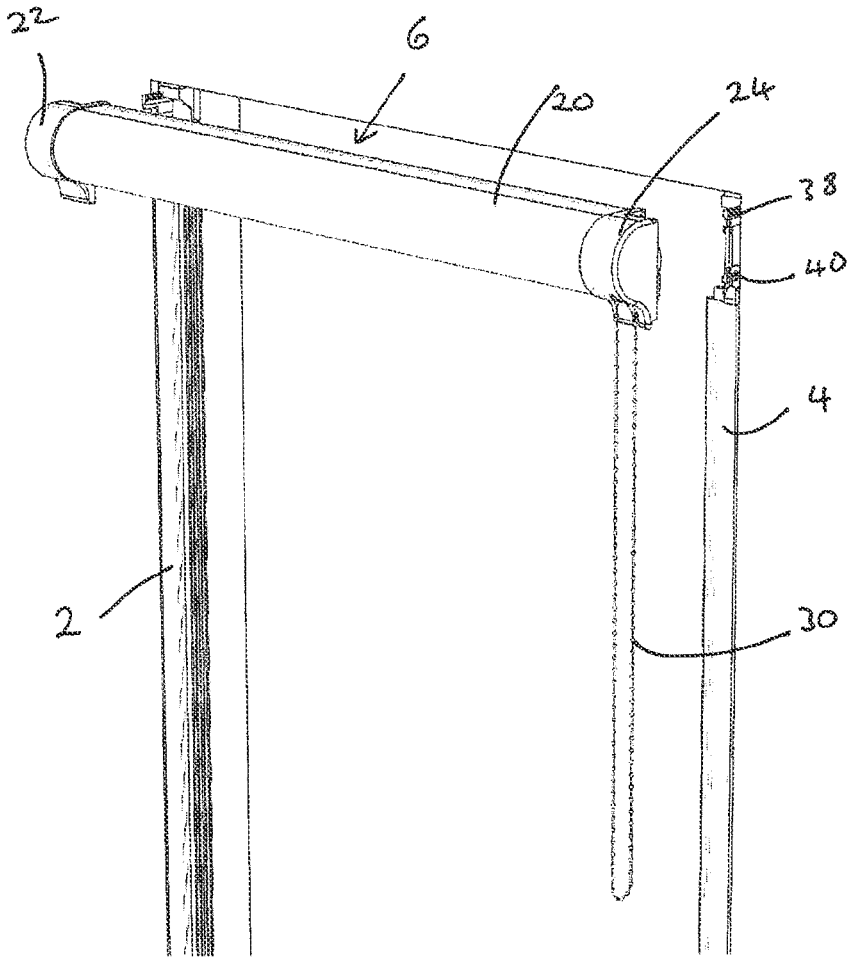
FIG. 5 is a perspective view of the screen assembly of FIG. 1 illustrating installation of the head assembly.

As illustrated in FIGS. 3 and 4, the drive may include a threaded fastener 14 adapted to be screwed out of a threaded base member 16 to extend the upper foot 12 from the respective side rail 2,4. An upper end of the threaded fastener 14 may be adapted to engage a lower side of the upper foot 12. The threaded base member 16 may be integrally formed in an upper end of the respective side member 2,4. The threaded fastener may be provided with a suitable formation, such as a bolt head or hexagonal aperture 18, for engagement by a suitable tool to facilitate rotation of the threaded fastener and extension of the upper foot 12 from the respective side rail 2,4.

Each foot of each side rail may be covered with a layer of a material having a high coefficient of friction, such as an elastomeric polymer or the like.

The head assembly 6 includes an elongate hollow housing 20 having a curved outer wall arranged to enclose the roller 8 and a portion of the screen 10 wound thereon and extending between a pair of end caps 22,24 fitted on either end of the housing 20. The screen 10 is arranged to extend through an elongate gap 26 in a lower side of the housing 20.

Each end cap 22,24 includes a mount or mounting for supporting a respective end of the roller 8, for example by engaging a pintle 28 extending from an adjacent end of the roller 8, and includes an attachment assembly for attaching the head assembly 6 to the side rails 2,4. At least one of the end caps 22,24 may be telescopically fitted over a respective end of the housing 20 and may include a biasing device, such as a spring, for urging the respective end cap 22,24 towards an extended position, thereby adjusting the width of the head assembly 6 to allow for variation in the width of the window opening. The biasing device may be incorporated into the mounting for supporting a respective end of the roller or incorporated with the pintle 28 extending from a respective end of the roller.

A drive mechanism may be incorporated into one of the end caps of the head assembly for rotating the roller to raise and lower the screen. The drive mechanism may include a chain wheel or sprocket (not shown) having an endless chain or cord 30 engaged therewith, the respective end cap 24 defining a chain/cord guide and chain/cord guard surrounding a portion of the chain wheel and including an opening at a lower side from which the endless chain or cord 30 may depend, in use. The drive mechanism may incorporate a clutch mechanism to prevent the weight of the blind from rotating the chain wheel or sprocket. In an alternative embodiment the drive mechanism may incorporate an electric motor for rotating the roller.

The side rails 2,4 may define a pair of opposing substantially U shaped guide tracks extending perpendicular to the respective sides of the window opening and within which a respective edge region of the screen 10 is guided during raising and lowering of the screen.

A guide bar 32 may be mounted on a lower end of the screen 10, the guide bar 32 being adapted to slide within the guide tracks defined by the side rails 2,4.

The attachment assembly of each end cap 22 of the head assembly may include a first part engageable with a second part provided at an upper end of each side rail 2,4. The first and second parts may be adapted to be coupled together at a plurality of different vertical positions with respect to one another to allow the vertical position of each end cap 22 to be adjusted on the respective side rail 2,4 to enable the head assembly 6 to be levelled and to take account of any misalignment of the side rails 2,4, for example due to the window opening not being completely square.

Figure 6:
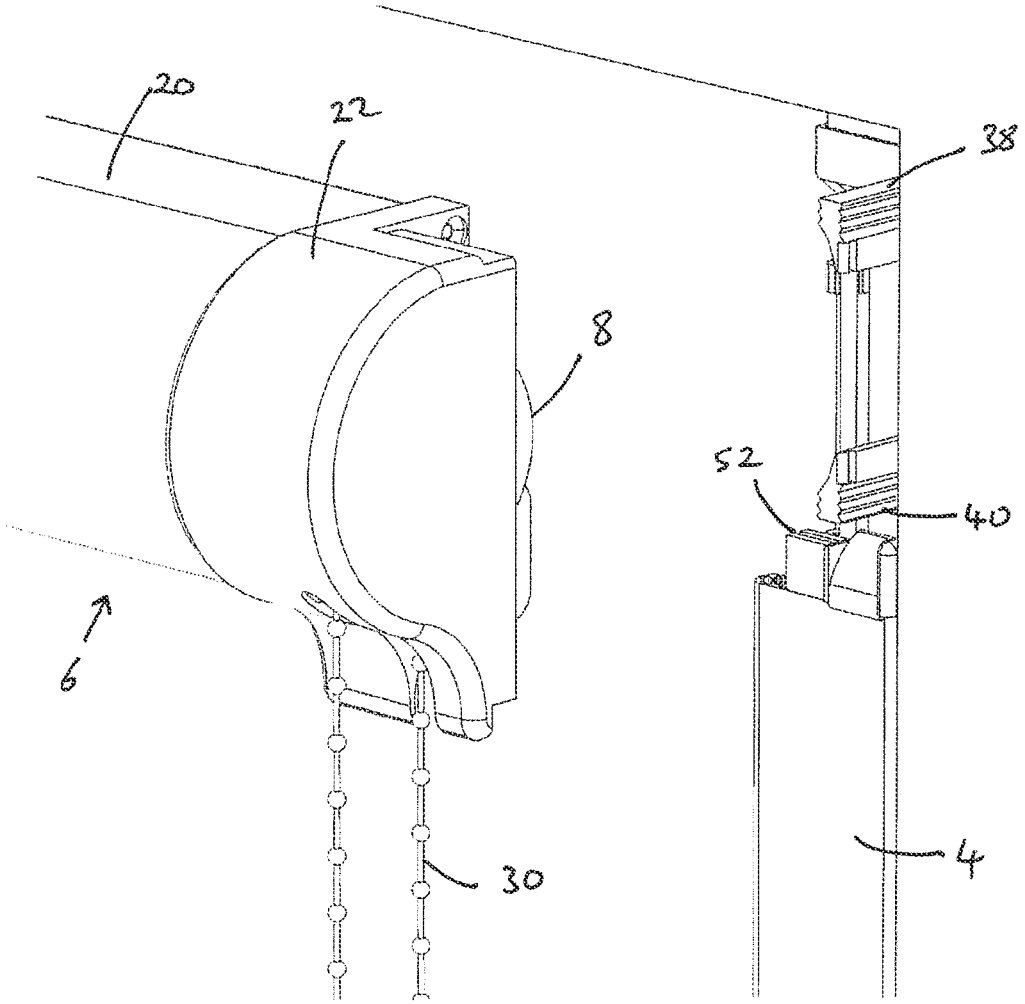
FIG. 6 is a detailed perspective view of the screen assembly of FIG. 1 illustrating installation of the head assembly.
Figure 7:
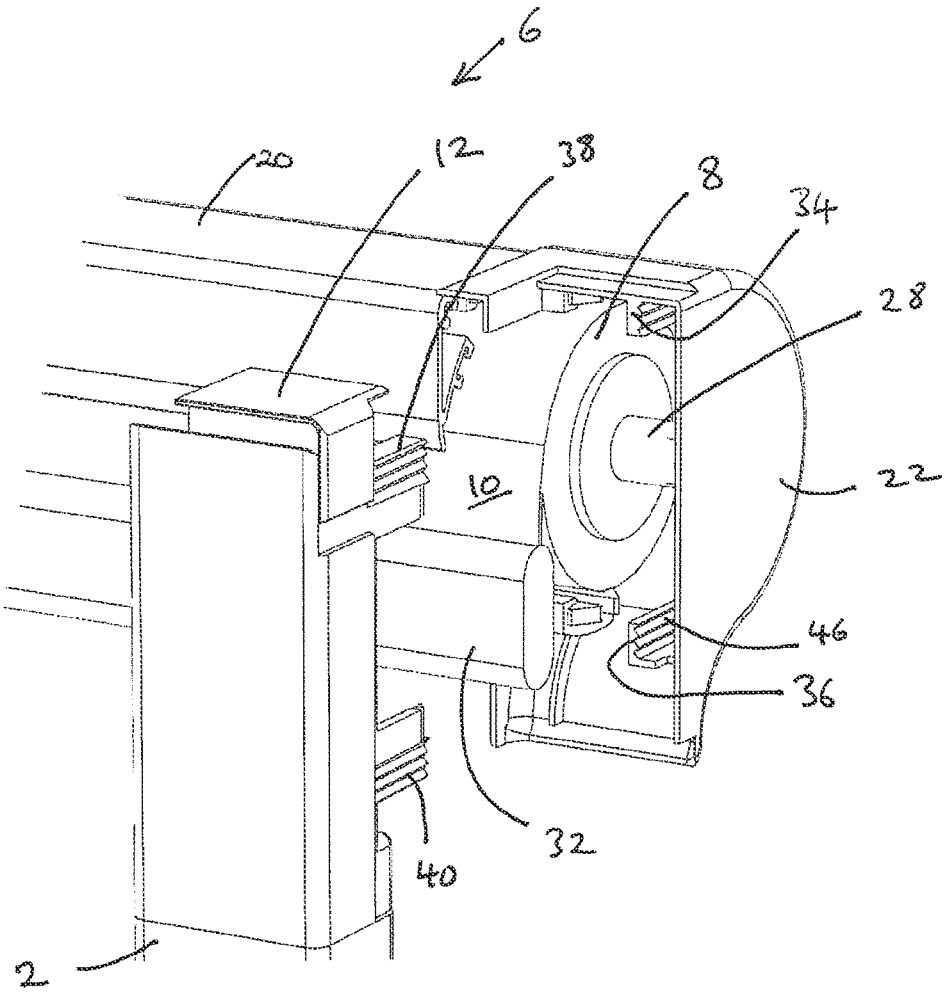
FIGS. 7 and 8 are rear detailed perspective views of the screen assembly of FIG. 1 illustrating installation of the head assembly onto the side rails.
Figure 8:
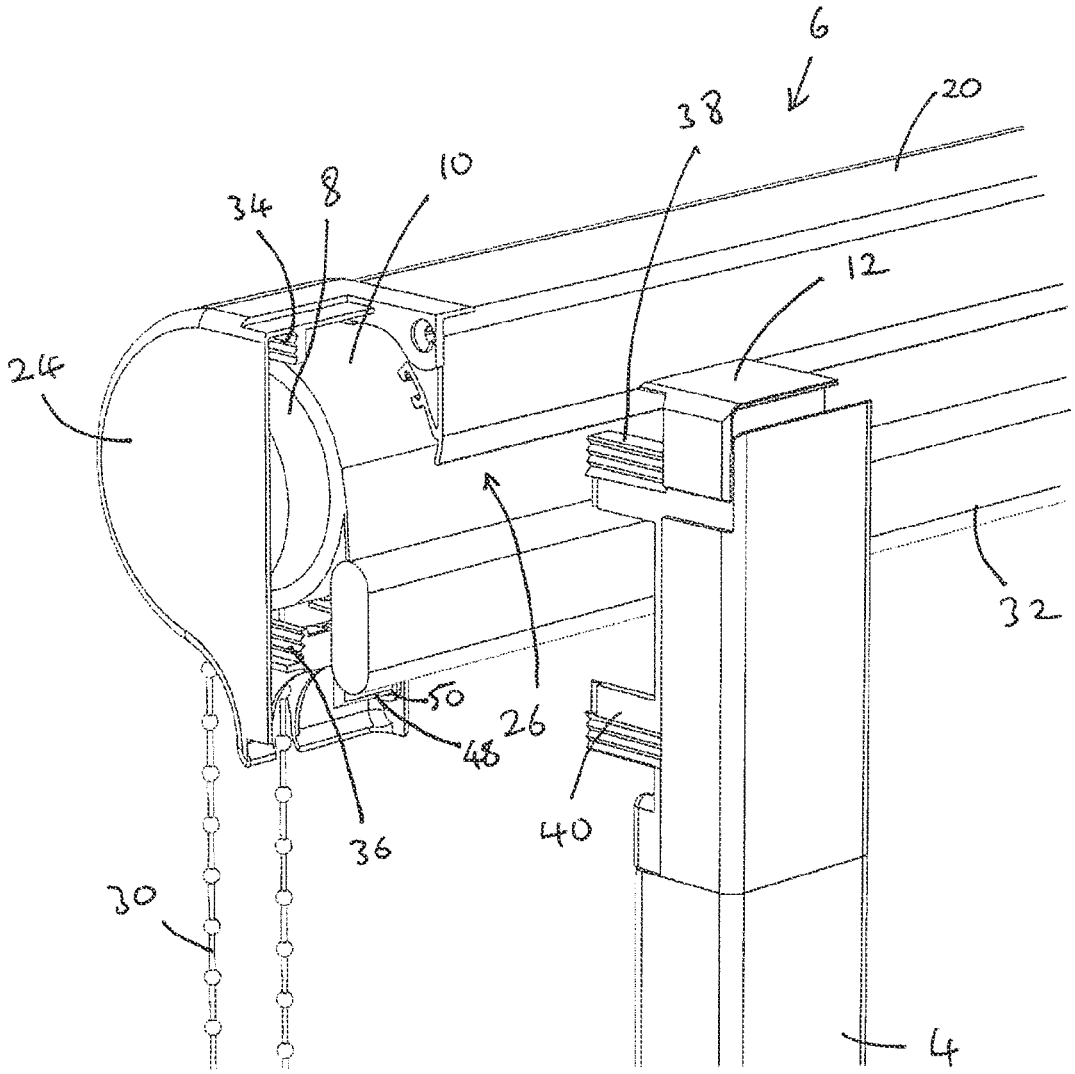

With reference to FIGS. 6 to 8, the first part of each attachment assembly may include vertically spaced and substantially horizontally extending opposed channels 34,36 extending parallel to an end surface of the respective end cap 22,24 to define a vertically aligned and horizontally extending slot into which is slidingly received a pair of parallel legs 38,40 extending substantially horizontally from an upper end of each side rail to attach the head assembly 6 to the side rails 2,4. The inner faces of the channels 34,36 and cooperating outer faces of the legs 38,40 are provided with serrated or tooth like formations 42,46 adapted to engage one another as the legs 38,40 are slid into the channels 38,40 so that the end caps 22,24 can be mounted on the respective side rails 2,4 in a number of different vertically spaced positions. The relative vertical location and level of the head assembly 6 with respect to an upper side of the window opening can therefore be adjusted within the limits of the difference between the distance between upper and lower faces of the legs 38,40 and the width of the slot defined by the channels 34,36 within which the legs 38,40 are received.

Figure 9:
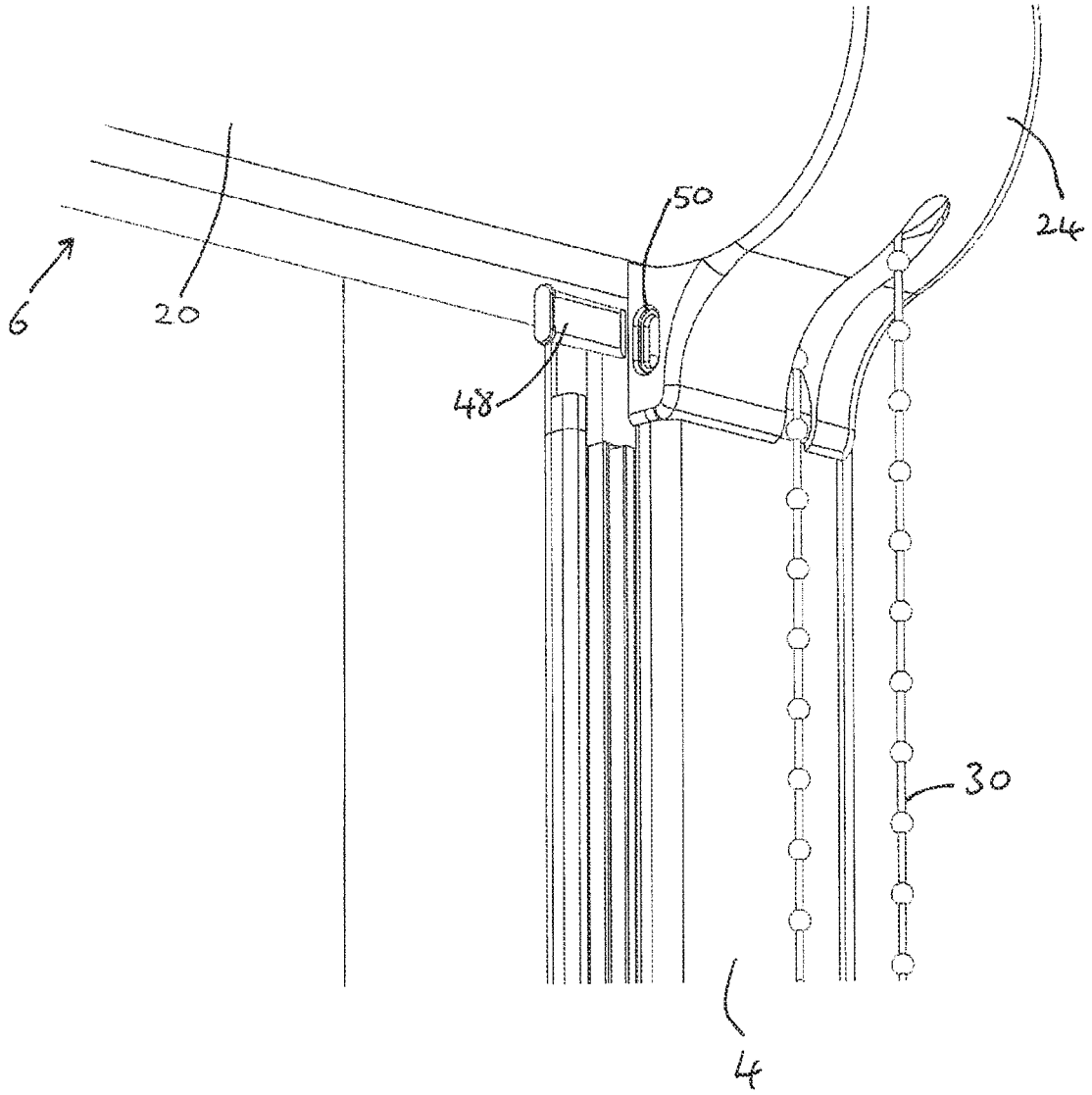
FIGS. 9 and 10 are detailed perspective views of the screen assembly of FIG. 1 illustrating the arrangement for retaining the head assembly on the side rails.
Figure 10:
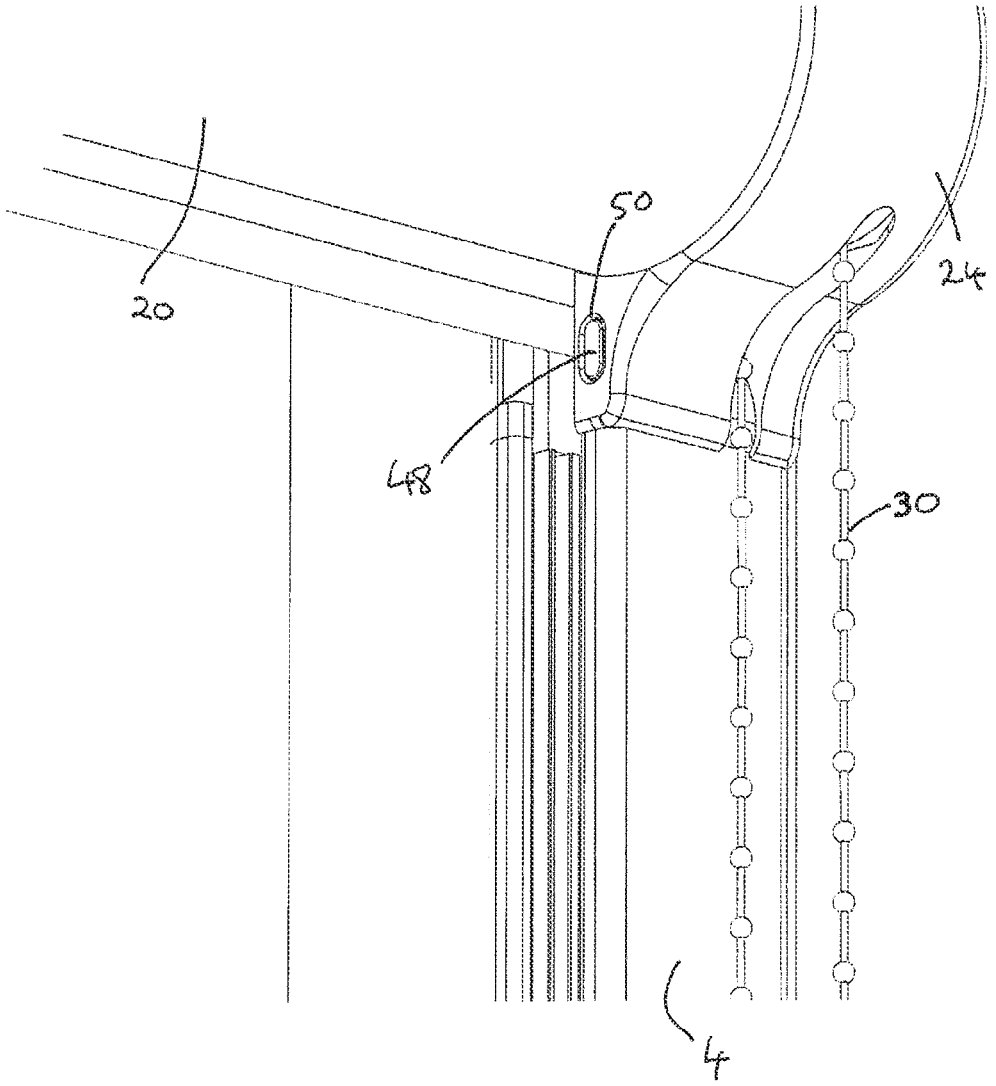

As illustrated in FIGS. 9 and 10, in order to secure the head assembly 6 to the side rails 2,4 once the legs 38,40 of the side rails 2,4 have been engaged with the channels 34,36 of the end caps 22,24 locking pins 48 are inserted through receiving channels 50 in the end caps 22,24 of the head assembly 6 to engage apertures 52 formed in the side rails 2,4 (see FIGS. 3 and 4).

In use, the side rails 2,4 are located on either side of the window opening between the upper and lower faces of the window opening and the upper feet 12 are extended until they are brought into frictional engagement with the window opening, as shown in FIG. 4, thereby securing the side rails 2,4 within the window opening. Next the head assembly 6 is mounted onto the side rails 2,4 by locating the legs 38,40 of the side rails 2,4 into the slots defined by the opposing channels 34,36 in each end cap 22,24 of the head assembly, as illustrated in FIGS. 5 to 8. The or each telescopically fitted end cap 22,24 is biased outwardly by the biasing device to engage the sides of the window opening as the head assembly 6 is installed into the window opening. The relative vertical location and level of the head assembly 6 with respect to an upper side of the window opening is adjusted within the limits of the difference between the distance between upper and lower faces of the legs 38,40 and the width of the slot defined by the channels 34,36 within which the legs 38,40 are received and retained at the selected level and height by virtue of the cooperating serrated or tooth like formations 42,46 which engage one another as the legs 38,40 are slid into the channels 38,40. Once the head assembly 6 is attached to the side rails 2,4 the locking pins 48 are inserted into the aligned receiving channels 50 and receiving apertures 52 to lock the head assembly 6 onto the side rails 2,4, as illustrated in FIGS. 9 and 10.

As such, the screen assembly in accordance with an embodiment of the present invention can be quickly and easily installed into a window opening without any damage to the window opening due to drilling and without the use of additional fasteners and facilitates levelling of the head assembly, thereby ensuring reliable operation of the screen.

The U profile side rails 2,4, defining guide slots within which the screen 10 slides, and the head assembly 6 enclosing the roller 8 and screen 10 and the close fit between the side rails 2,4 and head assembly 6 and the sides of the window opening ensures that the screen reliably and completely shuts out light from passing through the window opening when the screen is closed.

The invention is not limited to the embodiments described herein but can be amended or modified without departing from the scope of the present invention, which is intended to be limited only by the scope of the appended claims as interpreted according to the principles of patent law including the doctrine of equivalents.

The invention claimed is:

1. A screen assembly for a window, said screen assembly comprising:

a pair of parallel and spaced apart side rails having upper and lower ends, wherein said side rails are locatable against respective sides of a window opening; and a head assembly including a roller upon which is wound a screen, said head assembly extending between said side rails and adapted to be mounted on said upper ends of said side rails to be supported thereon against or adjacent to an upper side of the window opening;

wherein each of said side rails is linearly extendable so that said upper and lower ends of said side rails frictionally engage upper and lower faces of the window opening to secure said side rails, and said head assembly mounted thereon, in place within the window opening;

wherein said head assembly comprises an elongate hollow housing adapted to enclose said roller and a portion of said screen wound thereon and extending between a pair of end caps fitted on ends of said housing, wherein said screen is arranged to extend through an elongate gap in a lower side of said housing;

wherein each of said end caps includes a mount for supporting a respective end of said roller and an attachment assembly for attaching said head assembly to said side rails; and wherein said attachment assembly of each of said end caps of said head assembly comprises a first part engageable with a second part provided at said upper end of each of said side rails, said first and second parts being adapted to couple together at a plurality of different vertical positions with respect to one another to allow the vertical position of each of said end caps to be adjusted on the respective side rail to facilitate levelling of said head assembly.

2. The screen assembly of claim 1, further comprising:

a foot at each of said upper ends and at lowers ends of each of said side rails and adapted to frictionally engage respective upper and lower faces of the window opening, at least one of said feet of each of said side rails being linearly extendable from a remainder of the respective side rail to adjust the length of said side rail;

one of said feet at each of said side rails comprising an upper foot at said upper end of each of said side rails and linearly extendable therefrom; and a drive for extending each of said upper feet from the respective side rail.

3. The screen assembly of claim 2, wherein said drive comprises a threaded rod adapted to be screwed out of a threaded base member of the respective side rail to extend said each of said upper feet from the respective side rail.

4. The screen assembly of claim 1, wherein at least one of said end caps is telescopically fitted over a respective end of said housing and includes a biasing device for urging the respective end cap towards an extended position to adjust the width of said head assembly to allow for variation in the width of the window opening.

5. The screen assembly of claim 1, wherein said first part of each of the attachment assemblies comprises vertically spaced and substantially horizontally extending opposed channels extending parallel to an end surface of the respective end cap to define a vertically aligned and horizontally extending slot into which is slidingly received a pair of parallel legs extending substantially horizontally from said upper end of each of said side rails, said legs defining said second part of the respective attachment assembly.

6. The screen assembly of claim 5, wherein inner faces of said channels and cooperating outer faces of said legs are provided with cooperating serrated or tooth like formations adapted to engage one another as said legs are slid into said channels such that said end caps can be mounted on the respective side rails in a number of different vertically spaced positions.

7. The screen assembly of claim 6, wherein the relative vertical location and level of said head assembly with respect to the upper side of the window opening is adjustable within limits defined by a difference between the distance between upper and lower faces of said legs and the width of said slot that is defined by said channels within which said legs are received.

8. The screen assembly of claim 1, wherein said side rails define a pair of opposing substantially U-shaped guide tracks adapted to extend perpendicular to the respective sides of the window opening and within which a respective edge region of said screen is guided during raising and lowering of said screen, and wherein a guide bar is mounted on a lower end of said screen, said guide bar being adapted to slide within said guide tracks defined by said side rails.

9. A screen assembly for a window, said screen assembly comprising;

a pair of parallel and spaced apart side rails locatable against respective sides of a window opening;

a head assembly including a roller upon which is wound a screen, said head assembly extending between said side rails and adapted to be mounted on upper ends of said side rails to be supported thereon against or adjacent to an upper side of the window opening;

wherein said head assembly comprises;

an elongate hollow housing adapted to enclose said roller and a portion of said screen wound thereon; and a pair of end caps fitted on ends of said housing, with said roller and said portion of said screen extending between said end caps, said screen being arranged to extend through an elongate gap in a lower side of said housing;

each of said end caps including a mount for supporting a respective end of said roller and an attachment assembly for attaching said head assembly to said side rails; and said attachment assembly of each of said end caps comprising a first part engageable with a second part provided at said upper end of each of said side rails; and wherein said first and second parts are adapted to couple together at a plurality of different vertical positions with respect to one another to allow the vertical position of each of said end caps to be adjusted on the respective side rail to facilitate levelling of said head assembly.

10. The screen assembly of claim 9, further comprising a foot at each of said upper ends and at lower ends of each of said side rails, wherein said feet are adapted to frictionally engage respective upper and lower faces of the window opening, at least one of said feet of each of said side rails being linearly extendable from a remainder of the respective side rail to adjust the length of said side rail.

11. The screen assembly of claim 10, wherein said upper foot at said upper end of each of said side rails is linearly extendable therefrom, and further comprising a drive for extending each of said upper feet from the respective upper ends of said side rails.

12. The screen assembly of claim 11, wherein said drive comprises a threaded rod adapted to be screwed out of a threaded base member of the respective side rail to extend one of said upper feet from the respective side rail.

13. The screen assembly of claim 12, wherein said threaded rod is provided with a formation for engagement by a tool to facilitate rotation of said threaded rod and extension of said one of said upper feet from the respective side rail.

14. The screen assembly of claim 9, wherein at least one of said end caps is telescopically fitted over a respective end of said housing and includes a biasing device for urging the respective end cap towards an extended position to adjust the width of said head assembly to allow for variation in the width of the window opening.

15. The screen assembly of claim 14, wherein locking members are insertable through receiving channels in said end caps of said head assembly to engage receiving apertures formed in said side rails to secure said head assembly to said side rails.

16. The screen assembly of claim 9, wherein said first part of each of said attachment assemblies comprises vertically spaced and substantially horizontally extending opposed channels extending parallel to an end surface of the respective end cap to define a vertically aligned and horizontally extending slot into which is slidingly received a pair of parallel legs extending substantially horizontally from said upper end of each of said side rails, said legs defining said second part of the respective attachment assembly.

17. The screen assembly of claim 16, wherein inner faces of said channels and cooperating outer faces of said legs are provided with cooperating serrated or tooth like formations adapted to engage one another as said legs are slid into said channels such that said end caps can be mounted on the respective side rails in a number of different vertically spaced positions.

18. The screen assembly of claim 17, wherein the relative vertical location and level of said head assembly with respect to the upper side of the window opening is adjustable within limits defined by a difference between the distance between upper and lower faces of said legs and the width of said slot that is defined by said channels within which said legs are received.

19. The screen assembly of claim 9, wherein said side rails define a pair of opposing substantially U-shaped guide tracks adapted to extend perpendicular to the respective sides of the window opening and within which a respective edge region of said screen is guided during raising and lowering of said screen.

20. The screen assembly of claim 19, wherein a guide bar is mounted on a lower end of said screen, said guide bar being adapted to slide within said guide tracks defined by said side rails.

* * * * *